US009631858B2

(12) United States Patent
Mirza et al.

(10) Patent No.: US 9,631,858 B2
(45) Date of Patent: Apr. 25, 2017

(54) ADJUSTABLE SHELF FOR A COOLING DEVICE

(75) Inventors: Alper Mirza, Istanbul (TR); Sati Mutlu, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 1735 days.

(21) Appl. No.: 12/811,348

(22) PCT Filed: Dec. 6, 2008

(86) PCT No.: PCT/EP2008/066947

§ 371 (c)(1), (2), (4) Date: Oct. 2, 2010

(87) PCT Pub. No.: WO2009/083381

PCT Pub. Date: Jul. 9, 2009

(65) Prior Publication Data

US 2011/0016912 A1 Jan. 27, 2011

(30) Foreign Application Priority Data

Dec. 31, 2007 (TR) ..... A2007/09248

(51) Int. Cl.
*F25D 11/00* (2006.01)
*F25D 23/04* (2006.01)

(52) U.S. Cl.
CPC ..... *F25D 23/04* (2013.01); *F25D 2325/021* (2013.01)

(58) Field of Classification Search
CPC ..... F25D 23/04; F25D 2325/021
USPC ..... 62/377, 440, 449; 312/9.6, 34.2, 116, 312/125, 401
See application file for complete search history.

(56) References Cited

U.S. PATENT DOCUMENTS 4,186,978 A * 2/1980 Thomson ..... 312/321.5
5,584,405 A * 12/1996 Tunzi ..... 211/153

FOREIGN PATENT DOCUMENTS

JP 59056680 A 4/1984
KR 20040068782 A 8/2004
WO 2006011084 A 2/2006
WO WO 2006011084 A1 * 2/2006 ..... A47B 96/02

* cited by examiner

*Primary Examiner* — Elizabeth Martin
(74) *Attorney, Agent, or Firm* — Kilpatrick Townsend & Stockton LLP

(57) ABSTRACT

A shelf (5) for a cooling device having supporting walls (4 and 104) of different sizes and forms and joined with each other from at least one edge so that either the first support wall (4) or the second support wall (104) are almost vertically upward to the supporting wall which enables goods disposed thereon to be carried by supporting them from below while the other supporting wall supports the goods from the sides.

12 Claims, 2 Drawing Sheets

ADJUSTABLE SHELF FOR A COOLING DEVICE

FIELD

The present invention relates to a cooling device comprising a shelf used in different positions.

BACKGROUND

In cooling devices, preferably in refrigerators, shelves are provided, whereon foods, beverages or goods are disposed. Particularly door shelves are produced with guards to be able to keep the foods to be stored safely. Guards for shelves are made in accordance with the sizes of foods. For example, shelves with high guards, whereon mainly bottles are stored, have the same width and length with other shelves and their only difference is their guard heights. Making different types of shelves creates need for both component diversity and new investments for mould.

In the state of the art International Patent Application No WO2006011084, in cooling devices, a multi-functional door shelf is explained that can also be used turning upside down. In the patent application, a shelf enabling foods and beverages of different sizes to be carried when turned upside down by means of the holes formed on the base, and attachment housings enabling the shelf to be attached to the door, are described.

In the Korean Document No KR20040068782 known in the technique, a shelf is described, wherein narrow or wide use of the shelf is provided by different housings on the shelf engaging the protrusions on the door. However, when the shelf is attached to the frontal protrusions to use widely, a gap is formed at the back side of the shelf and the carried goods may fall down.

SUMMARY

The aim of the present invention is the realization of a cooling device comprising a shelf used in different function and position.

The cooling device realized in order to attain the aim of the present invention is explicated in the claims.

The cooling device comprises at least one shelf that is turned from the first position, wherein one of the supporting walls serves as base and the other as guard, to the second position, wherein the guard serves as base and the base as guard.

In an embodiment of the present invention, surface of the base is wider than the surface of the guard. Thus, wide and short goods can be stored in the cooling device when the shelf is in the first position.

In this embodiment, when the shelf is turned to the second position, then the base gets narrow and the guard gets high. Thus, high and narrow bottles are provided to be safely stored in the cooling device. Furthermore, when the shelf is used in the narrow position, the distance between the body shelf and the shelf increases, therefore even if big goods such as pot carried on body shelves overflow from the shelf, they are stored without impacting the door shelf.

In another embodiment of the present invention, the supporting wall used as base in the first position of the shelf is flat-shaped and the supporting wall used as guard is cavernous-shaped. Thus, when goods requiring support such as eggs and bottles are desired to be stored, the shelf is turned to the second position and the cavernous supporting wall is used as base. By means of this feature of the shelf, the user uses the shelf in the second position to store eggs and uses the shelf in the first position when extra space is required for other goods.

In the embodiment of the present invention, at least one retainer positioned on the shelf and at least one holder positioned on the door are fitted to each other and therefore provide the shelf to be carried on the door in its first and second positions. Holders and retainers may be formed as recesses and protrusions integrating each other.

In an embodiment of the present invention, side walls of the shelf and two U-shaped retainers each positioned vertically to each other on these walls are provided. Side walls of the door and holders are disposed, wherein retainers, corresponding spots of which are aligned at the same level, are mounted. In the first position of the shelf, the orifice of a U-shaped first retainer is mounted to the holder standing towards the base. The orifice of a second retainer positioned vertically to the first retainer faces the guard. When the shelf is turned to the second position, the orifice of the second retainer is mounted to the holder standing towards the base. The orifice of the first retainer again faces the guard vertically to the second retainer.

The shelf of the present invention does not comprise a rear wall because the portion that is at the back in the first position of the shelf comes to the upper side in the second position. Since the upper side of the shelf must be open for goods to be disposed, no rear wall is provided.

By means of the embodiment of the present invention, the shelf can be used as wide based-short guarded and high guarded-narrow based; flat or cavernous as required. Thus, single type shelf to store goods of different sizes is produced, different type of moulds are not required.

BRIEF DESCRIPTION OF THE DRAWING

The cooling device realized in order to attain the aim of the present invention is illustrated in the attached figures, where.

SUMMARY

Figure 1:
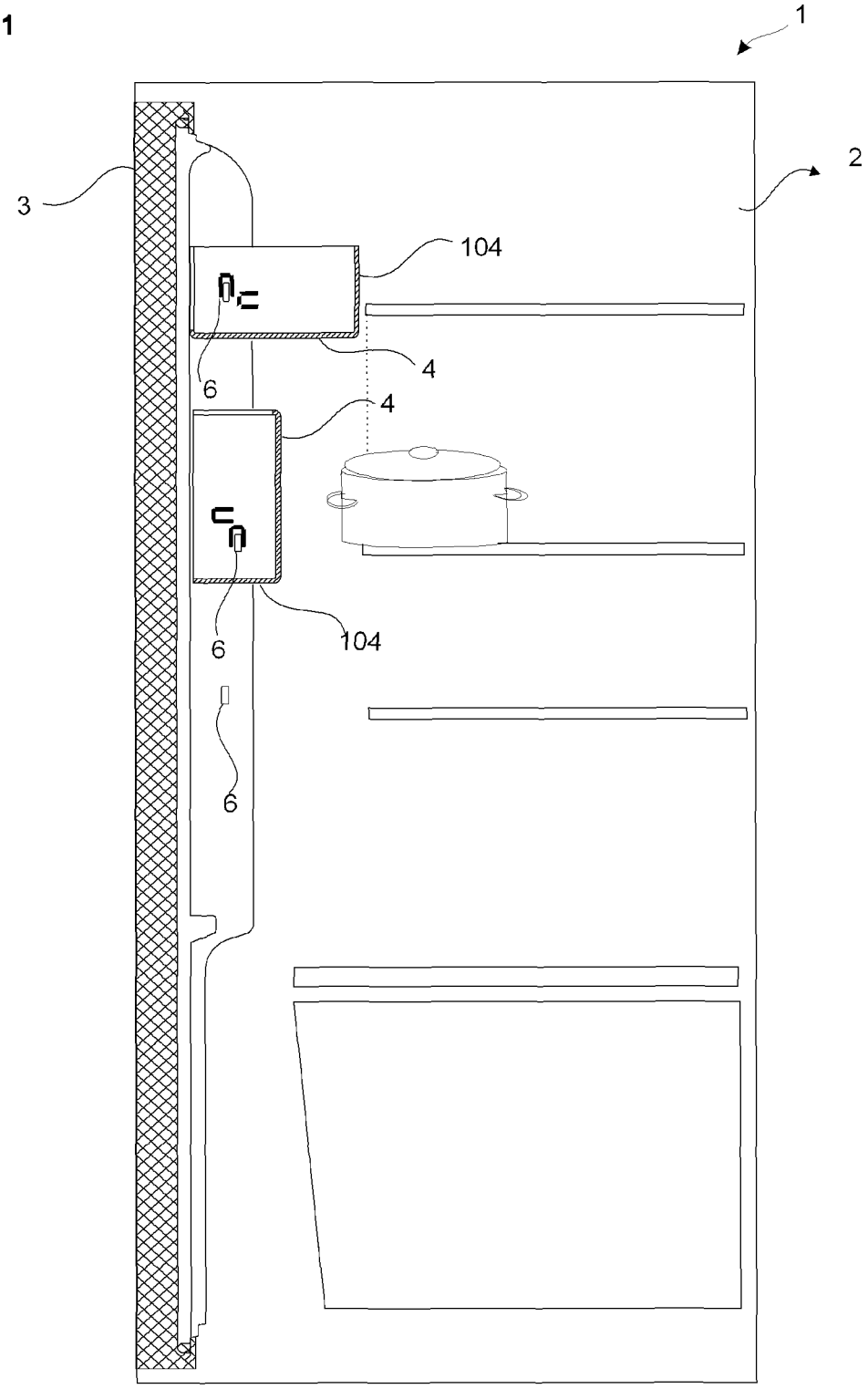
FIG. 1—is the perspective view of a cooling device comprising shelves in first and second positions.

The elements illustrated in the figures are numbered as follows:

1. Cooling device
2. Body
3. Door
4, 104. Supporting wall
5. Shelf
6. Holder
7, 107. Retainer The cooling device (1) comprises a body (2) wherein goods to be cooled are disposed, at least one door (3) providing access to inside of the body (2) and at least one shelf (5)

which comprises supporting walls (4 and 104) of different sizes and forms enabling the goods disposed thereon to be carried by supporting them from below and from the sides, and preventing them from falling down, being almost vertical to each other, joining with each other from at least one edge each;

which enables the first supporting wall (4) to carry the goods by serving as base and the second supporting wall (104) to support the goods from the front and from the sides by serving as guard in the I. position wherein the first supporting wall (4) is in the horizontal and the second supporting wall (104) is in the vertical position, and which enables the second supporting wall (104) to carry the goods by serving as base and the first supporting wall (4) to support the goods from the front and from the sides by serving as guard in the II. position, whereto the shelf is being turned according to the I. position.

Figure 2:
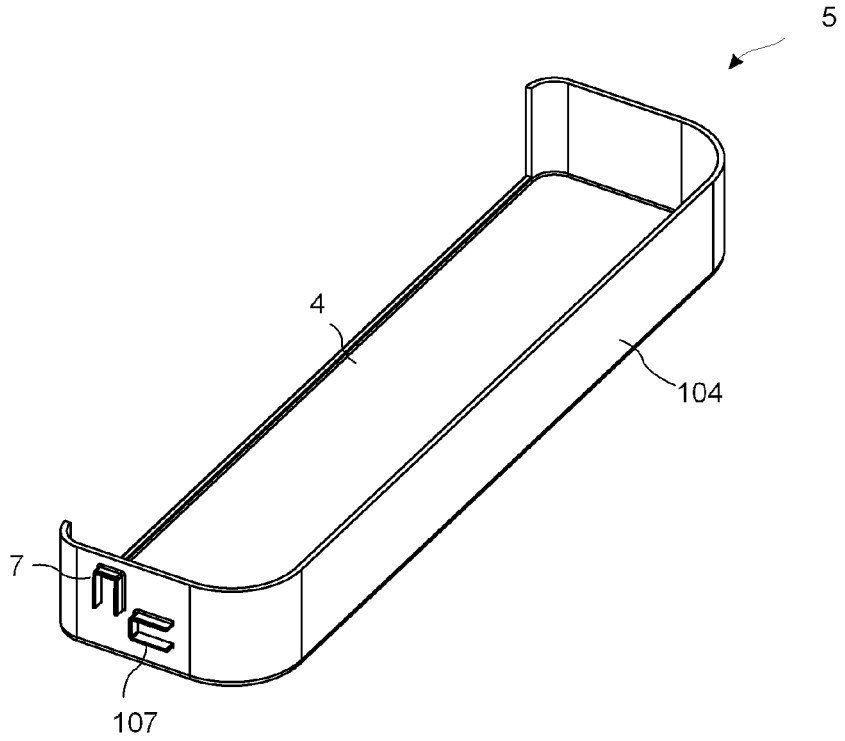
FIG. 2—is the perspective view of the usage of the shelf in the first position.
Figure 3:
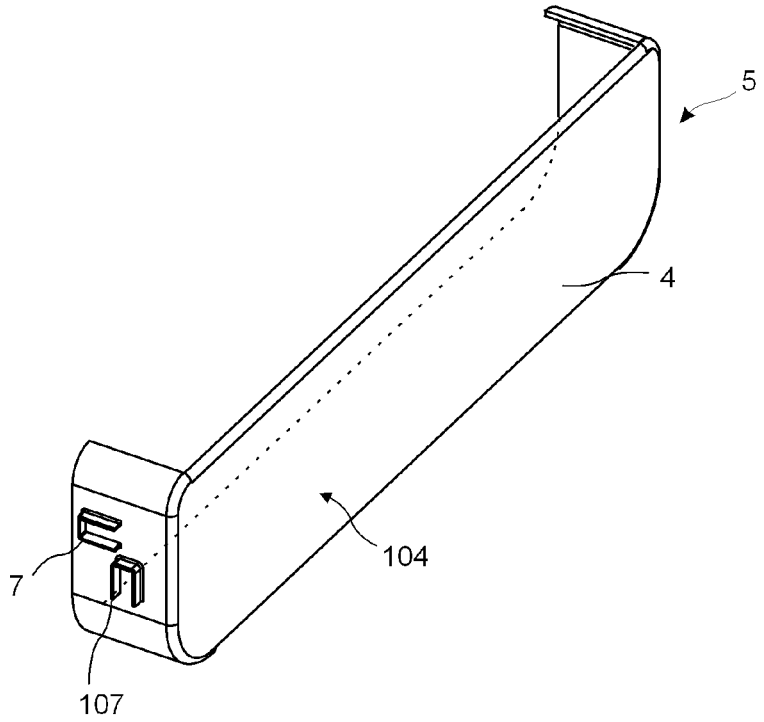
FIG. 3—is the perspective view of the usage of the shelf in the second position.

In an embodiment of the present invention, in the first position (I) of the shelf (5), the supporting wall (4) used as base is wider than the supporting wall (104) used as guard (FIG. 2). Here, the user uses the shelf (5) by mounting it to the door (3) as being wide based and short guarded. When the user desires to use a narrow based and high guarded shelf (5), removes the shelf (5) mounted on the door (3) in the first position (I) and mounts it on the door (3) in the second position (II) by turning it upside down (90 degrees to the front, 180 degrees to the side). Accordingly, the shelf (5) is changed to the second position (II), wherein the high supporting wall (4) is used as guard and the narrow supporting wall (104) as base. Thus, wide and short goods can be safely stored on the shelf (5) in the first position (I) and narrow and high goods in the second position (II). Furthermore, whereas the wide shelf (5) and the body (2) shelf are so close that they partially contact each other in the first position (I) of the shelf (5), the distance between the narrow shelf (5) and the body (2) shelf increases in the second position of the shelf (5). Thus, goods carried on the body (2) shelf are enabled to be carried on the body (2) shelf by partially overflowing to the space being emptied by the shelf (5) by narrowing without impacting the shelf (5).

In another embodiment of the present invention, one of the supporting walls (4) of the shelf (5) is flat-shaped and the other supporting wall (104) is cavernous-shaped for enabling the storage of different goods. Thus, when the shelf (5) is in the first position (I), flat bottomed goods are carried and when it is turned to the second position (II), goods such as eggs and bottles are carried in the suitably formed caverns.

The cooling device (1) of the present invention comprises at least one retainer (7, 107) on the shelf (5) for enabling the shelf (5) to be carried on the door (3) in both positions (I and II) and at least one holder (6) on the door (3) for this retainer (7, 107) to be mounted thereto.

In an embodiment of the present invention, two U-shaped retainers (7 and 107) vertically positioned to each other are provided on the outer side surfaces of the shelf (5). The orifices of the retainers (7-107) are vertically positioned to each other without facing each other and with an angle of 90 degrees therebetween. The holders (6) are positioned at the outer periphery of the door (3) side wall in a way that the retainers (7 and 107) can be mounted thereon.

When the shelf (5) is in the first position, orifice of the first retainer (7) is mounted to the holder (6), facing downwards. In the meantime, orifice of the second retainer (107) is idle, facing the supporting wall (104), which is used as guard.

When the shelf (5) is turned to the second position, orifice of the second retainer (107) is mounted to the holder (6), facing downwards. Orifice of the first retainer (7) is idle, facing the supporting wall (4), which is used as guard.

In an embodiment of the present invention, holders (6) and retainers (7 and 107) are formed as recesses and protrusions. Thus, holders (6) and retainers (7 and 107) are mounted to each other by easily engaging.

In the preferred embodiment of the present invention, the shelf (5) is shaped as a rectangular prism, upper and rear sides of which are open. Thus, the rear portion of the shelf (5), which is empty when mounted in a position, remains on the top when the shelf (5) is turned to the other position and goods can be loaded therefrom.

By means of the shelf (5) explained in the embodiment of the present invention, foods and beverages of different sizes can be stored by changing the position of the shelf (5). Thus, instead of producing high guarded-narrow based and short guarded-wide based shelf (5) types; flat- or cavernous-based shelf (5) types, monotype shelves (5) used by being turned as required are produced.

The invention claimed is:

1. A cooling device (1) comprising a body (2) wherein goods are disposed, at least one door (3) providing access to inside of the body (2) and at least one shelf (5) having a first supporting wall (4) and a second supporting wall (104) wherein the first supporting wall (4) and the second supporting wall (104) are of different sizes and forms and are joined almost vertically to each other by at least one edge each to form a base and a guard and wherein the at least one shelf can be coupled in different positions to the door (3) by selecting from the group consisting of either a I. position wherein the first supporting wall (4) is horizontal and the second supporting wall (104) is vertical above the first supporting wall (4) enabling the first supporting wall (4) to carry the goods by serving as the base and the second supporting wall (104) to serve as the guard above the base and support the goods, or a II. position wherein the second supporting wall (104) is horizontal and the first supporting wall (4) is vertical above the second supporting wall (104) enabling the second supporting wall (104) to carry the goods by serving as the base and the first supporting wall (4) to serve as the guard above the base and support the goods.

2. The cooling device (1) as in claim 1, wherein the first supporting wall (4) is wider than the second supporting wall (104).

3. The cooling device (1) as in claim 2, wherein the first supporting wall (4) is flat-shaped and the second supporting wall (104) is cavernous-shaped.

4. The cooling device (1) as in claim 3 wherein the shelf (5) further comprises a holder (6), wherein the holder (6) couples the shelf (5) to the door (3).

5. The cooling device (1) as in claim 4, wherein the shelf (5) further comprises a U-shaped first retainer (7) mounted to the holder (6) in the first position.

6. The cooling device (1) as in claim 5, wherein the shelf (5) further comprises a U-shaped second retainer (107) positioned vertically to the first retainer (7) and mounted to the holder (6) in the second position.

7. The cooling device (1) as in claim 6 wherein the shelf (5) includes a rear side which remains empty in either the I. position or the II. position, and which is shaped as a rectangular prism having open upper and rear sides.

8. The cooling device (1) as in claim 1, wherein the first supporting wall (4) is flat-shaped and the second supporting wall (104) is cavernous-shaped.

9. The cooling device (1) as in claim 1 wherein the shelf (5) further comprises a holder (6), wherein the holder (6) couples the shelf (5) to the door (3).

10. The cooling device (1) as in claim 9, wherein the shelf (5) further comprises a U-shaped first retainer (7) mounted to the holder (6) in a first position.

11. The cooling device (1) as in claim 9, wherein the shelf (5) further comprises a U-shaped second retainer (107) positioned vertically to the first retainer (7) and mounted to the holder (6) in a second position.

12. The cooling device (1) as in claim 1 wherein the shelf (5) includes a side which remains empty in either the I. position or the II. position, and which is shaped as a rectangular prism having open upper and rear sides.

* * * * *